United States Patent [19]

Naruse et al.

[11] Patent Number: 4,722,697

[45] Date of Patent: Feb. 2, 1988

[54] APPARATUS FOR TRANSFERRING A DRIVING FORCE TO JIG UNIT

[75] Inventors: Kazuo Naruse; Mikio Kitano; Hideaki Tobita, all of Aichi, Japan

[73] Assignee: Toyota Jidosha Kabushiki Kaisha, Toyota, Japan

[21] Appl. No.: 928,474

[22] Filed: Nov. 10, 1986

[30] Foreign Application Priority Data

Nov. 8, 1985 [JP] Japan ..... 60-172157[U]

[51] Int. Cl.[4] ..... H01R 13/629

[52] U.S. Cl. ..... 439/310; 439/372

[58] Field of Search ..... 339/75 R, 75 M, 15, 339/16 R, 34, 35; 439/310, 372

[56] References Cited

U.S. PATENT DOCUMENTS

| | | | |
|---|---|---|---|
| 1,290,066 | 1/1919 | Brown | 339/16 R |
| 2,997,682 | 8/1961 | Grimes et al. | 339/75 M |
| 3,635,184 | 1/1972 | Liautaud | 339/75 M |
| 3,673,541 | 6/1972 | Volinskie | 339/16 R |
| 4,531,799 | 7/1985 | Gray | 339/75 M |
| 4,630,878 | 12/1986 | Heine et al. | 339/75 M |

*Primary Examiner*—John McQuade

*Attorney, Agent, or Firm*—Finnegan, Henderson, Farabow, Garrett & Dunner

[57] ABSTRACT

An apparatus for transferring a driving force to a jig unit, comprising a plurality of fixed station coupling assemblies mounted on a support member, each assembly having a fixed station connector to which a driving force transfer means is connected; a jig unit coupling assembly mounted on a jig unit is provided to move in the direction of the fixed station coupling assembly for connecting the unit side connector to the fixed station connectors to feed a driving force to the jig unit; an actuating means is provided on one of the fixed and unit side coupling assemblies to move a respective connector in the direction to secure both fixed station and jig unit connectors in a connected position; and an engaging means holds both the coupling assemblies at a proper position by engaging locking parts provided on both coupling assemblies.

6 Claims, 7 Drawing Figures

APPARATUS FOR TRANSFERRING A DRIVING FORCE TO JIG UNIT

BACKGROUND OF THE INVENTION

1. Field of the Invention

The present invention relates to apparatus for transferring a driving force to a jig unit; and more particularly, to an apparatus for applying a driving force, such as electric power, working fluid of a hydraulic system, and compressed air, for example, to a unit which travels along a production line, and includes various types of jigs for welding, painting, riveting, screwing, and other production line operations.

2. Background Discussion

Generally, in a shop for assembling machines, or the like, a series of construction processes are carried out on a production line. In an automobile manufacturing plant, for example, various mechanisms such as the engine, suspension and other parts are assembled to a car body while traveling along an assembly line. Various jigs are used for such manufacture depending on the type of process; and a traveling jig unit which comprises individual jigs that are used for each different process, such as welding, painting or the like, as the occasion demands, travel along a path associated with the assembly line heretofor mentioned.

Heretofore, jigs for such a traveling jig unit included a driving system or device, such as a motor, an hydraulic cylinder, an air cylinder, or the like depending on the type of work each jig was to carry out. It was necessary to feed to each jig unit an energy medium such as electric power, hydraulic fluid, compressed air, and the like, (each of which is referred to herein as a "driving force") for driving a respective jig. These driving forces are fed to each driving device by way of a feeder consisting of a conductor such as a power line, a signal line, or the like; and piping for hydraulic fluid or compressed air, and the like.

Since the jig unit is movable, the feed means of the above-mentioned conductor, piping and the like has several applying means consisting of curl cord, flexible tube, and the like bundled up into one, and disposed in such manner, as not to interfere with the travel of the entire jig unit, and the operation of each jig. A guide cable or device, as the case may be, customarily is installed near the ceiling so as to connect the driving force to the jig from above, so as not to interfere, with the operation of the equipment near the floor of the plant.

However, the above-described conventional applying or transfer device for connecting the driving force to the traveling jig unit fails to address the following problems:

First, since such driving force transfer system constituted a curl cord, and flexible tubing, for example, coupled directly to the jig unit, the traveling range of the unit is limited by the length of the cord or tube. Thus, one jig unit is unable to cover a long process, or a plurality of processes, in an assembly line.

Also, in addition to the traveling range being limited as described above, a jig unit body and each individual jig may assume various modes of operation; therefore, the curl cord and the flexible tube, are capable of being twisted or entangled, thus hindering a normal operation of the jigs. Further the driving force transfer means for these curl cord and flexible tubes are readily worn out due to repeated operations of the jig unit and the jigs mounted on the unit, thereby subjecting the jig unit to damage.

SUMMARY OF THE INVENTION

An object of the present invention is to overcome the above described problems, and provide a jig unit which is not limited in its traveling range by a feed means.

Another object of the invention is to prevent the jig unit from being damaged due to wearing of the transfer or connecting means.

Additional objects and advantages of the invention will be set forth in part in the description which follows, and in part will be obvious from the description, or may be learned by practice of the invention. The objects and advantages of the invention may be realized and attained by means of the instrumentalities and combinations, particularly pointed out in the appended claims.

To achieve the objects and in accordance with the purpose of the invention, as embodied and broadly described herein, the apparatus of this invention for transferring a driving force from a fixed station to a movable jig unit, comprises a support member mounted at said fixed station, a first coupling assembly including a first connector mounted on said support member in communication with the driving force; a second coupling assembly including a second connector mounted on the jig unit; the second coupling assembly being disposed to move toward the first coupling assembly; upon movement of the jig unit toward the fixed station to position the second connector in a selected position relative to the first connector; engaging means adjacent the first and second connectors for locking the first and second connectors in a predetermined aligned relationship; and actuating means for operating at least one of the first and second aligned connectors for holding the connectors together in a predetermined coupled position.

Preferably such invention includes a plurality of fixed station coupling assemblies, each having a connector that may include, for example, a conductor connection terminal, and a coupling nozzle, such as an oil feeding pipe, a compressed air feed pipe, or the like mounted on a support member, such as an upright strut assembly, or the like, so as not to interfere with the path of the assembly line of an automobile manufacturing plant; and a coupling assembly having a respective connector connectable with a corresponding fixed station connector is provided on the jig unit adapted to travel on a guide rail or other means along the assembly line. The jig unit performs various operations such as framing, screwing, welding and other operations for the manufacture of an automobile, for example; and when the jig unit travels in the direction of the fixed station coupling assembly provided at major positions along the line for a particular process, the jig unit coupling assembly and the fixed station coupling assembly connect to each other; and an engaging means fixes both coupling assemblies securely to each other. Approximately simultaneously therewith an actuating means, which may be a hydraulic cylinder, or a spring, for example, is provided on the fixed station coupling assembly for causing the fixed station connector to shift toward the connector on the opposing jig unit for securing the connection of both the connectors.

According to the invention the means for transferring a driving force to a driving means of a jig unit body and jigs is separated into a driving force source side, and a driving force applied side; and the jig unit coupling assembly is connected and re-connected successively to a plurality of fixed station coupling assemblies provided at every required station. Therefore, the operating range of one jig unit is extended, and damage and wear to the applying means is minimized despite the repetitive and continuous operation of the jig unit, which enhances the durability of the device for applying a driving force to a jig unit.

The accompanying drawings, which are incorporated in and constitute a part of this specification, illustrate one embodiment of the invnetion and together with the description, serve to explain the principles of the invention.

DETAILED DESCRIPTION OF PREFERRED EMBODIMENT

In the specific embodiment, herein the driving force to be fed to a jig unit is electricity for power, and signals; and a conductor such as power line, a signal line, or the like, is employed as the transfer medium.

Figure 7:
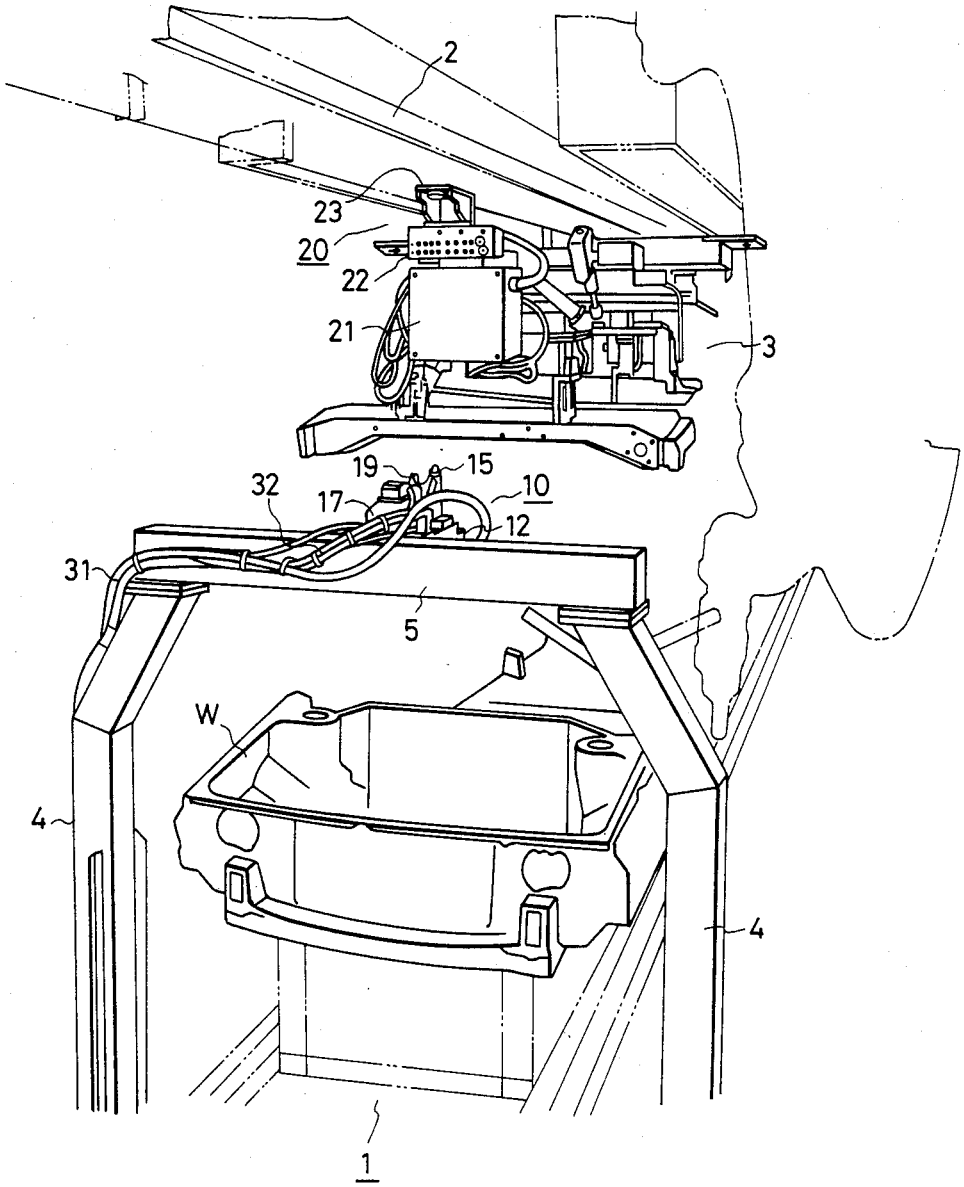
FIG. 7 is a bird's eye view in perspective of the entire transferring apparatus.

As shown in FIG. 7, a driving force transferring apparatus according to the present embodiment is provided on a jig unit 3 traveling along an assembly line 1, for example, of an automobile manufacturing plant, within a constant range, and at a constant period, along a guide member 2 provided near the ceiling, for carrying out the manufacture and work on a workpiece W of automobile, or the like. Straddling the line 1, is an inverted U-shaped structure formed by struts 4, 4 connected by support member 5 so as not to obstruct the path of the line 1. A fixed side or station coupling assembly 10 is mounted on the support member 5 at a predetermined position; and a jig unit coupling assembly 20 is mounted on the jig unit 3. In the drawing of FIG. 7, only one support member 5 and fixed station coupling assembly 10 is shown, the others of the plurality of provided coupling assemblies is omitted.

Figure 1:
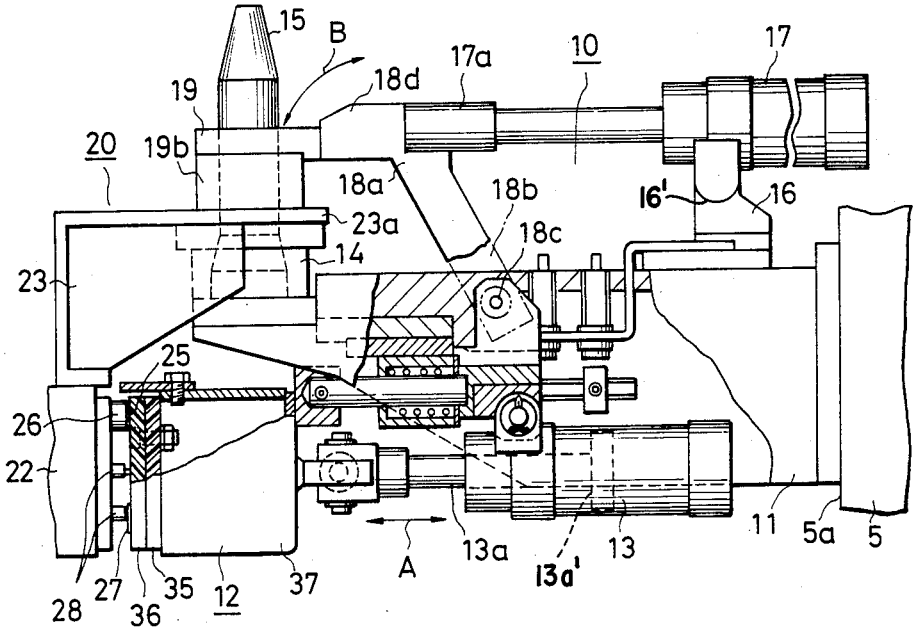
FIG. 1 is a side view, partly in section, illustrating the entire transferring apparatus according to one embodiment of the invention with the connectors coupled to each other.
Figure 6:
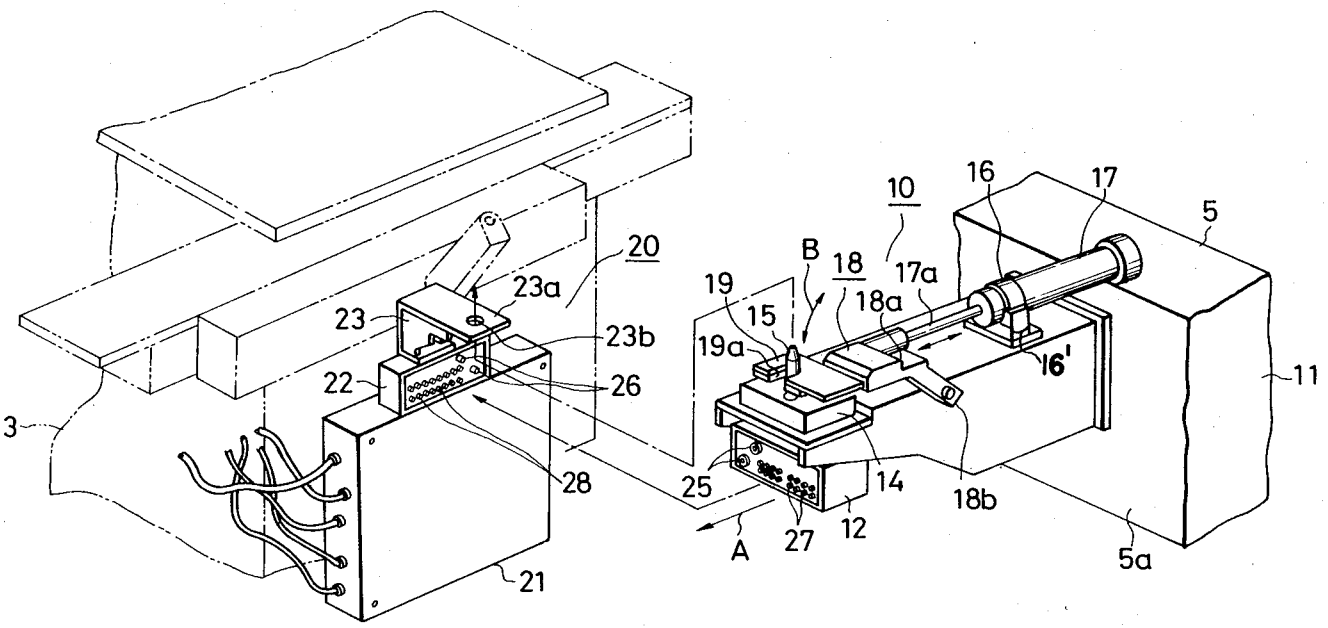
FIG. 6 is a perspective view illustrating the coupling assemblies at the fixed and jig unit sides when separated from each other.

As shown in FIG. 6 fixed station coupling assembly 10 is comprised of a support frame 11 having a base end fixed on a side wall 5*a* of support member 5; and a connector 12 provided within the support frame 11; and as shown in FIG. 1, connector assembly 12 is fixed on a rod 13*a* of a cylinder 13 driven by compressed air, hydraulic fluid or other driving force. Connector 12 is movable in the directions indicated by an arrow A adjacent cylinder 13. A holdfast member 14 is provided on a top nose of support frame 11, and a locating pin 15 is provided upright on holdfast member 14. A cylinder 17 is mounted on top of the base end of the support frame 11 through a mounting member 16 which is pivotal on arcuate surface 16'. A rod 17*a* of the cylinder 17 is fixed on a bend 18*a* of a doglegged pivotable press member 18. A base portion 18*b* of the pivotable press member 18 is journaled in the support frame 11 through a shaft 18*c*. A press plate 19 is provided on a nose portion 18*d*; and U-shaped notch groove 19*a* of the press plate 19 engages with the locating pin 15 when cylinder rod 17*a* elongates to keep the press plate 19 horizontal. Reference character 19*b* denotes a buffer plate fixed on a lower side of the press plate 19.

Referring next to the structure of coupling assembly 20 on the jig unit side. Jig unit 3 as shown in FIG. 7 travels in the direction of the workpiece W on the line 1 to a working position. Power for the work, and electric power, such as a detection signal or the like, are fed through fixed station coupling assembly 10. Accordingly, coupling assembly 20 is comprised, as shown in FIG. 6, of a connector 22 mounted on a switch box 21 for distributing power to each jig (not shown) of jig unit 3. A locating locking member 23 is provided on top of connector assembly 22. Locking member 23 has a hole 23*b* perforated in a locking plate 23*a* formed to protrude from a connection of the connector assembly 22 and having the locating pin 15 provided upright on a top nose of the fixed station support frame 11 fitted therein.

Referring to the fixed station and jig unit coupling assemblies 10 and 20 configured as described; when jig unit 3 travels toward the fixed station coupling assembly 10, hole 23*b* of jig unit locking member 23 fits over locating pin 15 and locking plate 23*a* comes in contact with holdfast member 14. Rod 17*a* of the cylinder 17 elongates to pivot rotary press member 18 downwardly as indicated by an arrow B in FIG. 6, which holds locking plate 23 against vertical movement, thereby locking the jig unit and fixed station coupling assemblies 10, 20 in alignment. Next piston 13*a*' attached to rod 13*a* in, cylinder 13 (FIG. 1) is driven to extend rod 13*a* as previously described, and the fixed station connector 12 is thus moved to come in contact with the unit side connector 22, and such further movement causes contact shoes 25 to 28 provided on both connectors are connected electrically to each other.

Figure 2:
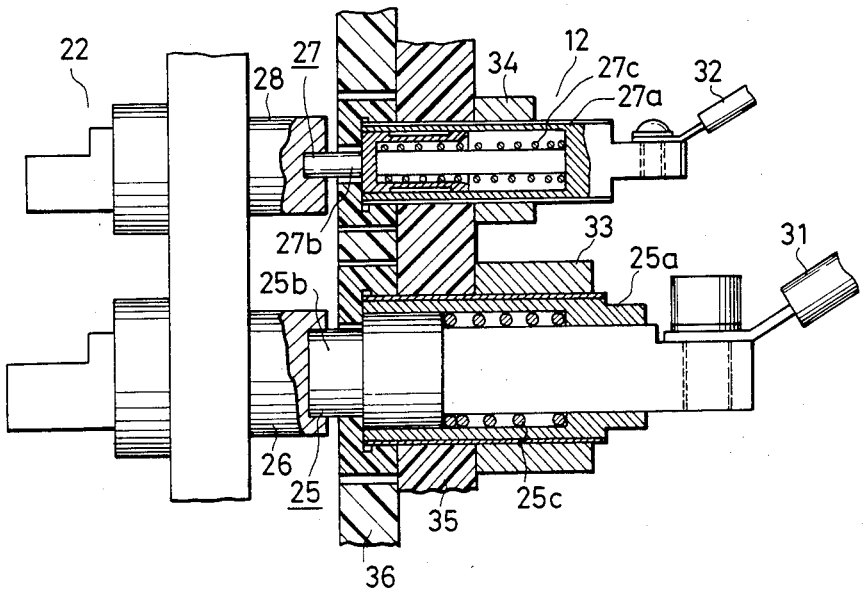
FIG. 2 is a fragmentary enlarged sectional view of the connectors.
Figure 3:
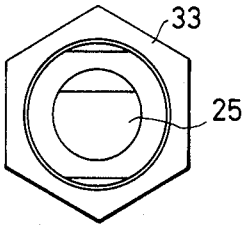
FIG. 3 and FIG. 4 are front views illustrating the shape of contact shoes for conducting electric power, and signals respectively, in the apparatus of the present invention.
Figure 4:
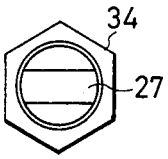
Figure 5:
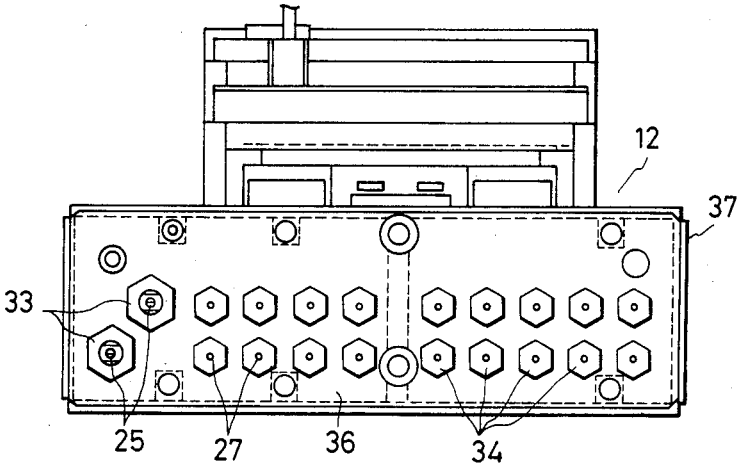
FIG. 5 is a front view showing an array of contact shoes for the connector.

Contact shoes 25 to 28 provided on connections of the connectors 12 and 22 coupled as above mentioned, will now be described with reference to FIG. 2 to FIG. 5. A power line 31 and a signal line 32 (FIG. 2) are connected to the fixed station connector 12 according to their respective capacities. Contact shoe 25 is connected to power line 31 by means of a hexagon fastener 33 shown in FIG. 2 and FIG. 3; and contact shoe 27 is connected to signal line 32 by means of a hexagon fastener 34 shown in FIG. 2 and FIG. 4. Contact shoes 25, 27 have tubular portions 25*a*, 27*a* fixed, as shown in FIG. 2, on an insulating plate 35 adjacent hexagon fasteners 33, 34 respectively. Springs 25*c*, 27*c* of phosphor bronze or the like which absorb collision of contact shoe nose portions 25*b*, 27*b* with the unit side contact shoes 26, 28 are provided in the tubular portions 25*a*, 27*a* respectively. Hexagon fasteners 33, 34 are fixed on two insulating plates 35, 36 provided on front side of the connector 12, and are further surrounded entirely by a waterproof cover 37. While no illustration nor detailed description is provided herein, a configuration practically the same as the described fixed station connector is also provided on a surface of the jig unit connector 12; and power fed through the unit side connector 22 drives each jig (not shown) by way of a distribution portion in switch box 21.

The above description is intended to represent only one preferred embodiment of the invention, and hence any variation and modification may take place without departing from object, configuration and effect of the invention.

For example, the above-described embodiment refers to a driving force transfer means including a feeding device for feeding power, and signals, to a jig unit. However, the invention is not necessarily limited thereto, and hence may be applied to a situation where other driving forces such as compressed air, hydraulic fluid and the like are fed to the jig unit side.

Further, in the embodiment herein the fixed station connector assembly 12 is described as being actuated by piston 13*a'* in cylinder 13 to solidly connect both connector assemblies 12 and 22; however, the invention is also not necessarily limited thereto, and hence an actuating means may be provided on the unit side connector assembly to solidly provide the connection from the unit side, or the actuating means may be provided on both the fixed side and unit side connector assemblies.

The actuating means has also been described as being comprised of a cylinder; however, it is also not necessarily limited thereto, and, needless to say, it can take the form of a combination of a motor and rack gear, and any other mechanism having a construction for providing a reciprocating motion.

Thus, it is intended that the present invention cover the modifications and variations of this invention, provided they come within the scope of the appended claims and their equivalents.

What is claimed is:

1. An apparatus for transferring a driving force from a fixed station to a movable jig unit, comprising:

a support member mounted at said fixed station;

a first coupling assembly in communication with the driving force, including a first connector mounted on said support member;

a second coupling assembly including a second connector mounted on said jig unit, said second coupling assembly being disposed to approach said first coupling assembly upon movement of said jig unit toward said fixed station to position said second connector in a selected position relative to said first connector;

engaging means disposed adjacent said first and second connectors including a first member, having a locating pin, mounted on one of said first and second coupling assemblies, and a second member, having an opening for receiving the locating pin for aligning the connectors, mounted on the other of said first and second coupling assemblies, and means mounted on said first member to pivot about an axis orthogonal to the axis of said locating pin for engaging said second member to lock said first and second connectors in a predetermined aligned relationship; and actuating means for operating at least one of said first and second aligned connectors in a direction relative to the other aligned connector for holding said connectors in a predetermined coupled position.

2. An apparatus according to claim 1 wherein the driving force is electrical.

3. An apparatus according to claim 1 wherein said actuating means includes a hydraulic piston connected to said second connector operative when extended to shift said second connector into contact position with said first connector.

4. An apparatus according to claim 3 wherein said first and second connectors each have a plurality of engaging contacts for transferring the driving force from one of said first and second connectors to the other when said second connector is in contact position with said first connector.

5. An apparatus according to claim 4 wherein the contacts on at least one of said connectors are spring loaded to absorb a collision upon operation of said actuating means.

6. An apparatus according to claim 1 wherein the locating pin of the first member is vertically extending, and the locking means includes a plate having a groove therein for receiving said pin and engaging the first member for locking the first and second connectors in a predetermined vertical relationship.

* * * * *